US012025004B2

(12) United States Patent
Davis

(10) Patent No.: US 12,025,004 B2
(45) Date of Patent: Jul. 2, 2024

(54) GRADE GUIDED TRACKLESS HORIZONTAL BORING RIG

(71) Applicant: Havailon Group, Marietta, GA (US)

(72) Inventor: Brent Douglas Davis, Smyrna, GA (US)

( * ) Notice: Subject to any disclaimer, the term of this patent is extended or adjusted under 35 U.S.C. 154(b) by 0 days.

(21) Appl. No.: 18/099,252

(22) Filed: Jan. 19, 2023

(65) Prior Publication Data

US 2023/0228154 A1 Jul. 20, 2023

Related U.S. Application Data

(60) Provisional application No. 63/301,015, filed on Jan. 19, 2022.

(51) Int. Cl.
*E21B 7/04* (2006.01)
*E21B 7/02* (2006.01)

(52) U.S. Cl.
CPC ..... *E21B 7/046* (2013.01); *E21B 7/022* (2013.01)

(58) Field of Classification Search
CPC ..... E21B 7/046; E21B 7/201
See application file for complete search history.

(56) References Cited

U.S. PATENT DOCUMENTS 1,285,712 A * 11/1918 Hughes ..... B23Q 11/0046 173/75
2,684,834 A * 7/1954 Miller ..... E21B 7/046 175/413
2,752,122 A * 6/1956 Hyatt ..... E21B 7/046 175/320
2,950,085 A * 8/1960 Lizzadro ..... E21B 7/046 254/29 R
3,288,229 A * 11/1966 Chappuis ..... E21B 7/005 173/147
3,526,285 A * 9/1970 Adkins ..... E21B 7/062 175/73
3,870,110 A * 3/1975 Richmond ..... E21B 19/086 175/103
4,062,196 A * 12/1977 Yoshida ..... E21B 7/201 405/184
4,691,788 A * 9/1987 Yoshida ..... E21B 7/005 175/203
5,228,525 A * 7/1993 Denney ..... E21B 3/02 175/122

(Continued)

*Primary Examiner* — Kipp C Wallace
(74) *Attorney, Agent, or Firm* — Cirino Patent Law; Michael Cirino

(57) ABSTRACT

A horizontal boring rig that may be used for the excavation of horizontal bores in soil or other substrates without the use of tracks or other supporting equipment. The boring rig may include a hydraulic motor or other powered device for turning an auger or other excavation tool. The hydraulic motor may be pivotally mounted to the boring rig and drive the bore string through an intermediate shaft including a universal joint. The degree of freedom provided by the universal joint and motor mounting prevents breakage of the boring string from deflection or kickback. A front guide may be used to prevent excessive deflection of the universal joint. The boring rig may ride on skids that allow the rig to follow a working grade and may incorporate spoil channels for directing excavated material around or away from the skid feet for improved accuracy in following the working grade.

20 Claims, 11 Drawing Sheets

(56) References Cited

U.S. PATENT DOCUMENTS

| | | | | | |
|---|---|---|---|---|---|
| 5,496,095 | A * | 3/1996 | Scholl | E21C 27/22 | 299/68 |
| 5,507,354 | A * | 4/1996 | Harleman | E21B 19/087 | 175/203 |
| 6,149,349 | A * | 11/2000 | Nikiforuk | E02F 5/10 | 405/184 |
| 6,343,663 | B1 * | 2/2002 | Hill | E21B 7/005 | 175/162 |
| 7,677,336 | B2 * | 3/2010 | Gent | E21B 7/005 | 175/323 |
| 2013/0068490 | A1 * | 3/2013 | Van Zee | E21B 17/18 | 173/40 |
| 2021/0317740 | A1 * | 10/2021 | Zadel | E21C 41/16 | |

* cited by examiner

GRADE GUIDED TRACKLESS HORIZONTAL BORING RIG

CROSS REFERENCE TO RELATED APPLICATIONS

The present application claims priority under 35 U.S.C. § 119(e) from U.S. Provisional Application Ser. No. 63/301,015, filed Jan. 19, 2022, entitled "Horizontal Boring Rig," the disclosure of which is hereby incorporated by reference herein in its entirety.

The present application is related to PCT application with International Application No. PCT/US23/11188, filed Jan. 19, 2023, entitled "Grade Guided Trackless Horizontal Boring Rig," the disclosure of which is hereby incorporated by reference herein in its entirety.

FIELD OF THE INVENTION

The present invention relates generally to the field of excavation equipment. More specifically, the invention is in the subfield of boring equipment.

BACKGROUND OF THE INVENTION

Infrastructure, commercial property, and residential property often require the laying of pipe underground for water, drainage, electric conduit, or other utilities. Prior to placing the pipe underground, a surface channel or underground bore must be excavated to allow for placement of the pipe or conduit. Digging of a channel is labor-intensive and time consuming and may not be possible or practicable for existing construction or when a bore must be placed under an existing structure.

Current boring equipment may allow for horizontal boring, but generally requires the use of tracks or other structures that are cumbersome, expensive, and that require large amounts of space that may not be available in the area where a bore is to be excavated. Furthermore, existing horizontal boring and excavation equipment is severely limited in both the diameter and depth of bore possible because current boring equipment tends to easily break augers and other boring tools, particularly when encountering rocks or other obstructions in the planned bore. As such, there is a need in the art for improved boring equipment that allows for wider and deeper bores to be excavated with less supporting equipment, without disturbing topsoil or surrounding material, and that prevents breakage of the excavation tool and bore string.

SUMMARY OF THE INVENTION

An aspect of an embodiment of the present invention provides a horizontal boring rig that may be used without tracks or other structural equipment, and allows for excavating larger, deeper bores while minimizing the risk of auger breakage. The horizontal boring rig may include a hydraulic motor or other rotational power source rotatably affixed to a base which rides along the grade to guide and align the bore. The horizontal boring rig also includes a drive mechanism with a universal joint and front guide to absorb deflection and shock from the auger during excavation. The drive mechanism allows for small misalignments and deflections of the auger without placing undue strain on the hydraulic motor output shaft, auger, or any other elements in the boring string. The horizontal boring rig may also include height adjustment components for aligning the bore relative to grade and may interface with standard equipment commonly used for construction and development of infrastructure.

The present invention horizontal boring rig may use the grade around and about the intended bore to align and direct the bore string into ground, soil, or other substrates. Because the horizontal boring rig does not require laying a track or other supporting equipment, the horizontal boring rig may be easily connected to equipment that is above or below the grade where the bore is to be excavated, including in pits or other confined areas.

DESCRIPTION OF THE DRAWINGS

The accompanying drawings, which are incorporated into and form a part of the instant specification, illustrate several aspects and embodiments of the present invention and, together with the description herein, serve to explain the principles of the invention. The drawings are provided only for the purpose of illustrating select embodiments of the invention and are not to be construed as limiting the invention.

DETAILED DESCRIPTION OF EXEMPLARY EMBODIMENTS OF THE INVENTION

Figure 1:
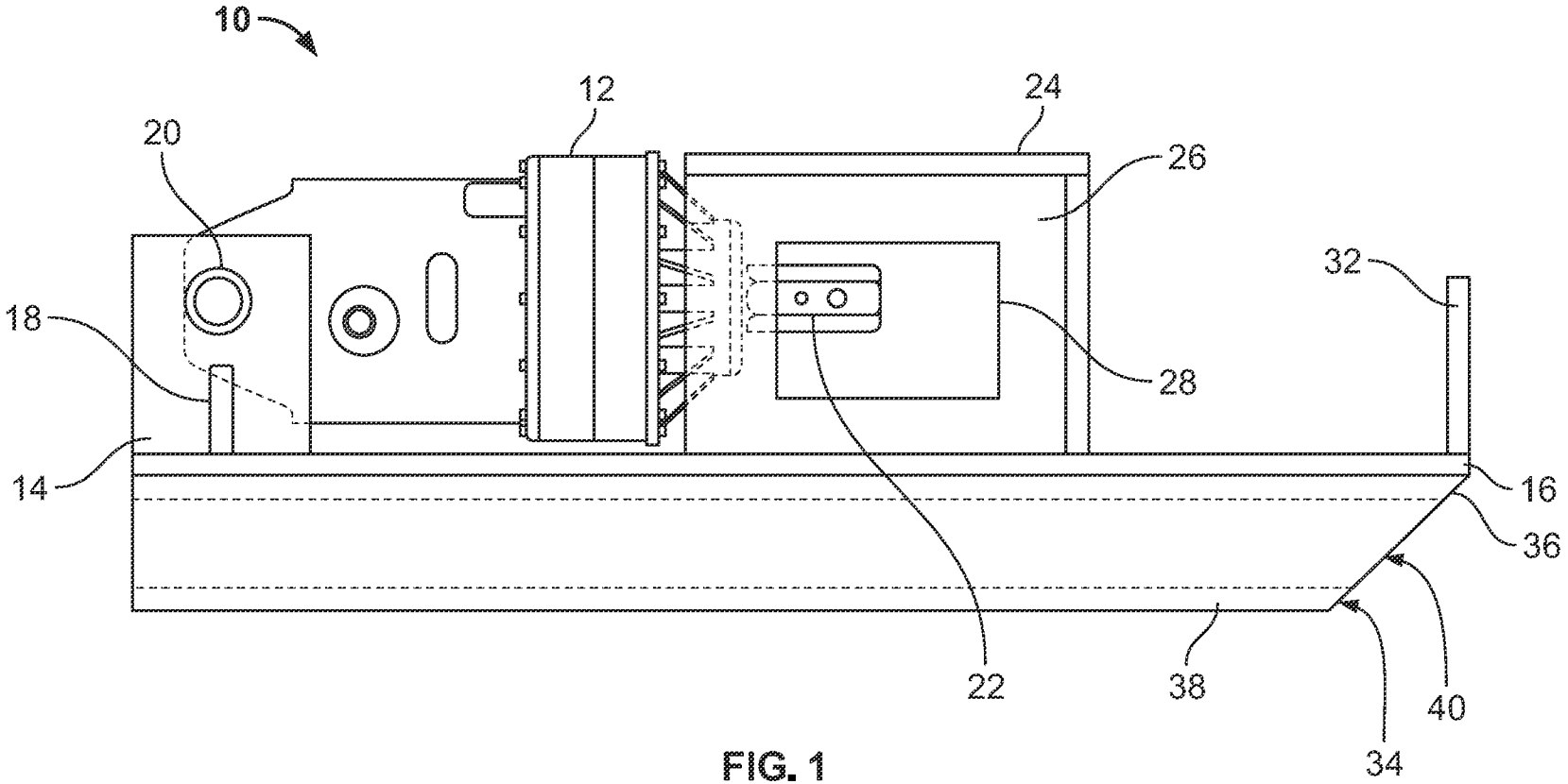
FIGS. 1 and 2 provide schematic depictions of an exemplary embodiment of a horizontal boring rig for excavating horizontal bores.
Figure 2:
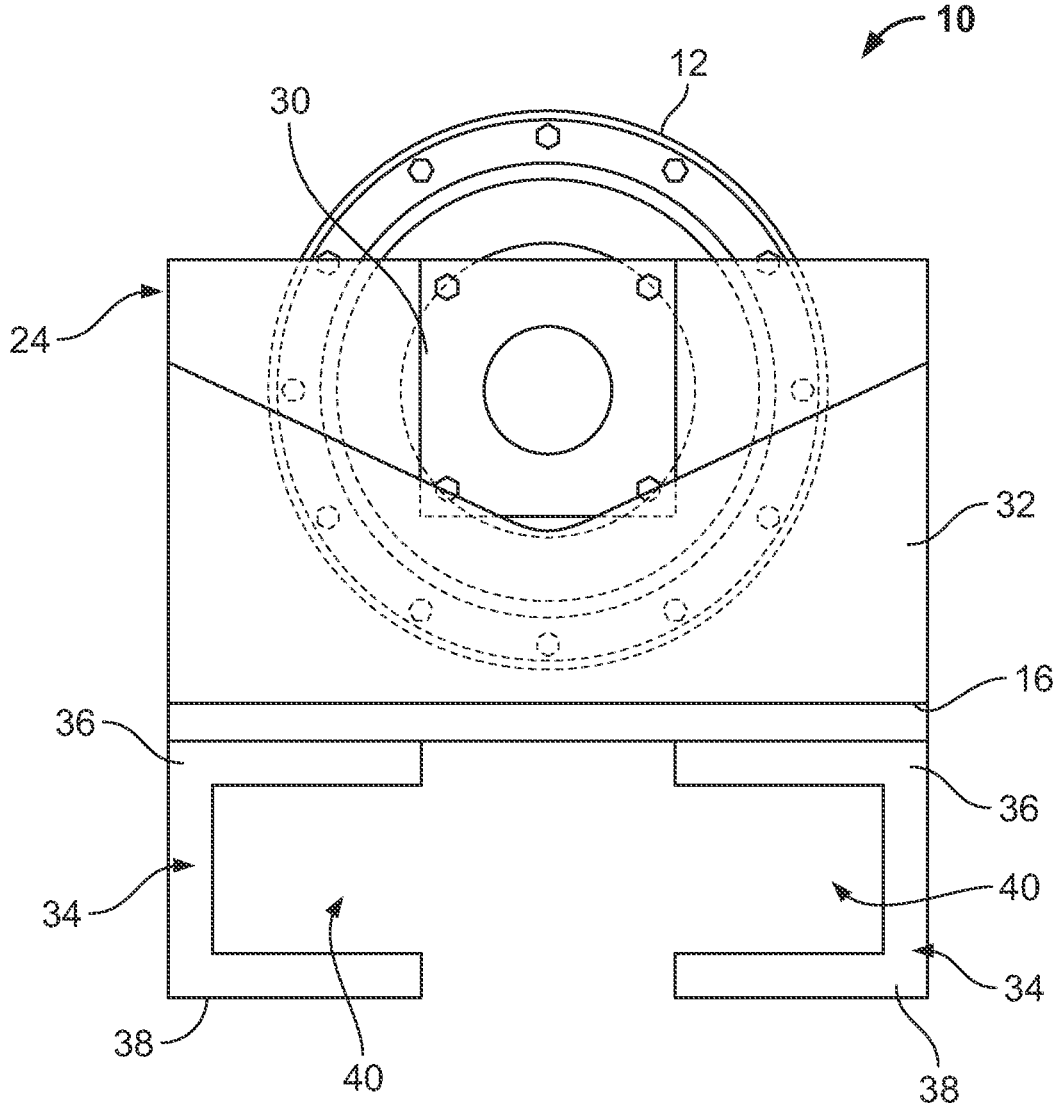

FIGS. 1 and 2 provide schematic depictions of an exemplary embodiment of a trackless horizontal boring rig 10 for excavating pipe or conduit bores. The horizontal boring rig 10 may comprise a hydraulic motor 12 in rotatable communication with one or more pivot plates 14, which in turn are in communication with the top side of a base plate 16. A rear motor support 18 may also provide a rest or brace for the hydraulic motor 12 or prevent excessive rotation of the hydraulic motor 12 about the pivot 20. The hydraulic motor 12 may include an output shaft 22 contained within a drive box 24 that may include an inspection plate 26 with an inspection aperture 28. The output shaft 22 of the hydraulic motor 12 may couple to or otherwise be in communication with an intermediate shaft (shown below) that passes through a front bearing 30 on the drive box 24 and may include a universal joint (described below). A front guide 32 in communication with the base plate 16 provides extra support and limits the deflection of the intermediate shaft when the horizontal boring rig 10 is excavating a bore.

Still referring to FIGS. 1 and 2, the base plate 16 may be in communication with one or more skids 34 that may ride along the working grade of a construction site. The one or more skids 34 may comprise a base plate support 36 at the upper portion of the skid 34 for mounting to, and supporting the weight of, the base plate 16, and a skid foot 38 at the lower portion of the skid 34 to provide a flat surface for riding along the working grade. It should be appreciated that in certain exemplary embodiments, the skid 34 may attach directly to the base plate 16 without a base plate support 36. A spoil channel 40 may be disposed between the base plate support 36 and the skid plate foot 38. However, in exemplary embodiments wherein the skid 34 attaches directly to the base plate 16 without a base plate support 36, the spoil channel 40 may be defined by the bottom side of the base plate 16 and the skid foot 38. In certain embodiments, the spoil channel 40 may be facing inwards, such that spoil from the bore excavation is channeled between the skids 34 and under the base plate 16 of the horizontal boring rig 10. During excavation, the skid foot 38 of the skid 34 may ride along the working grade while spoil rides over the skid foot 38 and is directed by the spoil channel 40. As a result, the skid foot 38 will remain in contact with the working grade to excavate a bore that is straight and properly directed. It should be appreciated that the spoil channel 40 of the skid 34 may also be orientated towards the outside of the horizontal boring rig 10 to direct spoil outwards and away from the horizontal boring rig 10 for removal. Furthermore, in certain embodiments, the skids 34 may be provided as separate pieces for attachment to the base plate 16 of the horizontal boring rig 10, or the skids 34 may be integral with the base plate 16 of the horizontal boring rig 10.

When in use, the hydraulic motor 12 or other rotational power source may rotate the output shaft 22, which in turn may rotate an intermediary shaft with a universal joint and coupling (described below). It should be appreciated that in certain embodiments, the output shaft 22 may be integral with the hydraulic motor 12 or other rotational power source, or it may be a separate piece used in conjunction with the hydraulic motor 12 and intermediate shaft. This intermediary shaft may then be coupled with or otherwise in communication with an auger or other excavation tool. When the horizontal boring rig 10 is powered up, the horizontal boring machine 10 may be advanced into dirt, soil, or other material to excavate a bore. During excavation, the presence of rocks, materials of different density, or other obstructions in the bore path may cause deflection or shock to the auger. This deflection or shock may then cause the universal joint to deflect and absorb the shock transferred from the auger back towards the horizontal boring rig 10. The universal joint allows for deflection while the bore string continues to rotate, protecting the hydraulic motor 12, output shaft 22, auger, and intermediate shaft from breakage. The front guide 32 of the horizontal boring rig 10 functions to limit the deflection of the universal joint to prevent excessive misalignment of the bore string. As shown, the front guide 32 may have a general V-shape contour for controlling the deflection of the intermediate shaft and bore string. However, it should be appreciated that the front guide 32 may have any contour, including, but not limited to, circular, oval, elliptical, or any other shape as desired or required for a particular application. Furthermore, in certain embodiments, the front guide 32 may include an upper portion to partially or completely surround the intermediate shaft and provide deflection control in all directions about the intermediate shaft. Similarly, the pivot 20 at the rear of the hydraulic motor 12 allows for a degree of freedom for the hydraulic motor 12 when operating to absorb vibration, variations in drive power, motor torque reaction, or kickback from the bore string. This may help prevent damage to the hydraulic motor 12, bore string, or the horizontal boring rig 10 structure.

Figure 3:
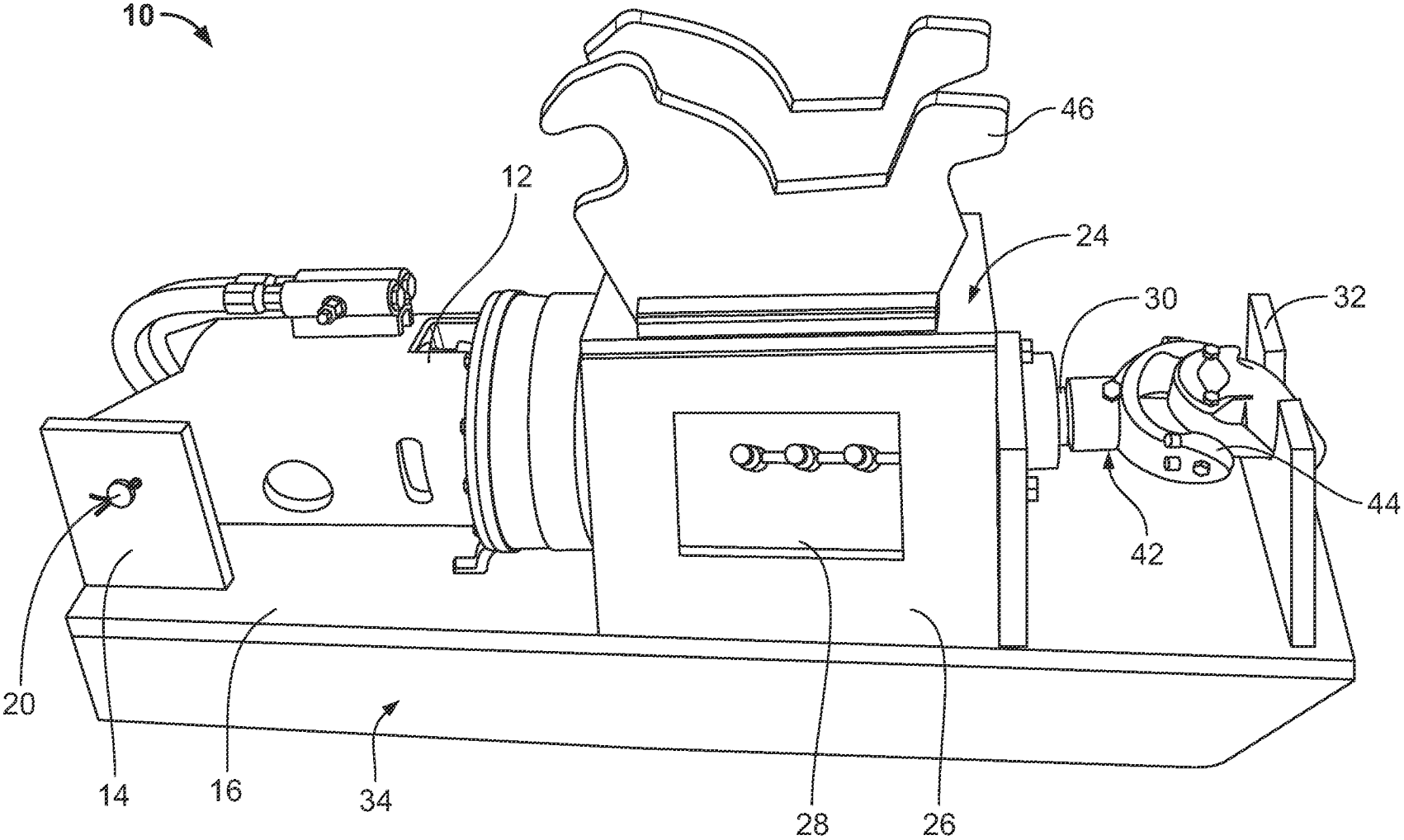
FIG. 3 provides a schematic depiction of a horizontal boring rig with an equipment mount for connection to construction equipment.

FIG. 3 provides a depiction of an embodiment of a horizontal boring rig 10 with an equipment mount 46 for connection to a backhoe or other earthmoving or construction equipment. The horizontal boring rig 10 may comprise a hydraulic motor 12 in communication with an intermediate shaft 42, which may be in communication with an auger or other boring or excavation equipment (shown in FIGS. 4-6). It should be appreciated that in certain embodiments, the intermediate shaft 42 may be integral with the hydraulic motor 12, or the output of the hydraulic motor 12, or it may be provided as a separate piece. The coupling or other attachment between the output shaft 22 of the hydraulic motor 12 and the intermediate shaft 42 may be contained within a drive box 24, which may include an inspection plate 26 with an inspection aperture 28 and a front bearing 30 for supporting the intermediate shaft 42. The intermediate shaft 42 may also include a universal joint 44 for allowing deflection of the bore string and to provide damping and isolation of the hydraulic motor 12 and horizontal boring rig 10 from shock or deflection induced by the auger or excavation tool. A front guide 32 may limit the motion or deflection of the intermediate shaft 42 during operation. The hydraulic motor 12 may be in rotatable communication with the base plate 16 of the horizontal boring rig 10 through one or more pivots 20 in communication with one or more pivot plates 14, which in turn are in communication with the base plate 16. The horizontal boring rig 10 may ride along the working grade via one or more skids 34 in communication with the base plate 16.

The horizontal boring rig 10 may be in communication with an equipment mount 46, which may be affixed or otherwise attached to the top of the drive box 24. The drive box 24 provides structure and support to the equipment mount 46 so that the horizontal boring rig 10 may be coupled to excavation or other construction equipment, such as a backhoe or excavator. The drive box 24 may be configured or otherwise structured to accept any number of equipment mounts 46 to allow for coupling the horizontal boring rig 10 to any available construction or excavation equipment. It should be appreciated that the horizontal boring rig 10 may receive hydraulic, electric, or other power sources from the construction or excavation equipment that it couples with. Once coupled, the construction or excavation equipment may be used to move, position, power, and control the rotational speed, direction, and positioning of the horizontal boring rig 10 when excavating a bore.

Figure 4:
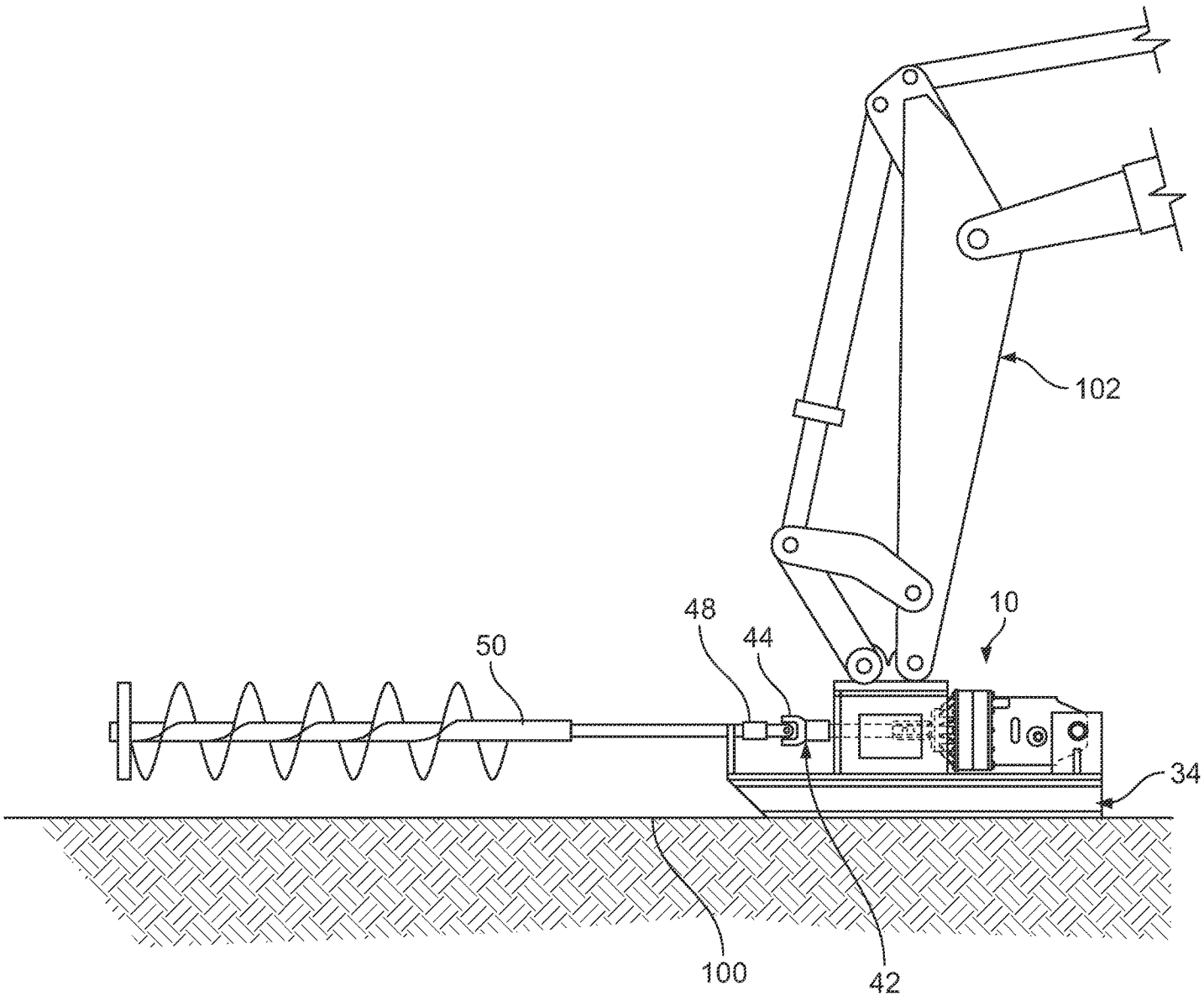
FIG. 4 provides a schematic depiction of a horizontal boring rig in use in use on a working grade.

FIG. 4 provides a schematic depiction of a horizontal boring rig 10 coupled with construction equipment 102 and an excavation tool. The horizontal boring rig 10 may be coupled with an auger 50 or other excavating tool through a coupling 48 on the intermediate shaft 42. A universal joint 44 allows for deflection and absorption of shock while the horizontal boring rig 10 is in use to prevent boring string breakage or damage to the horizontal boring rig 10 and its associated parts. As shown, the horizontal boring rig 10 may be coupled with the arm of an excavator machine or other construction equipment 102. The excavator 102 may then lift, extend, retract, or otherwise move the horizontal boring rig 10 as necessary to position the horizontal boring rig 10 and to advance it during the excavation of a bore. During excavation, the horizontal boring rig 10 may ride along a grade 100 on one or more skids 34. The skids 34 facilitate using the grade 100 as a guide to align and direct the bore excavation while directing any spoil away from the horizontal boring rig 10 during use. It should be appreciated that the excavator 102 may provide pressurized hydraulic fluid to the horizontal boring rig 10 to power the hydraulic motor and turn the auger 50 or other excavation tool.

Figure 5:
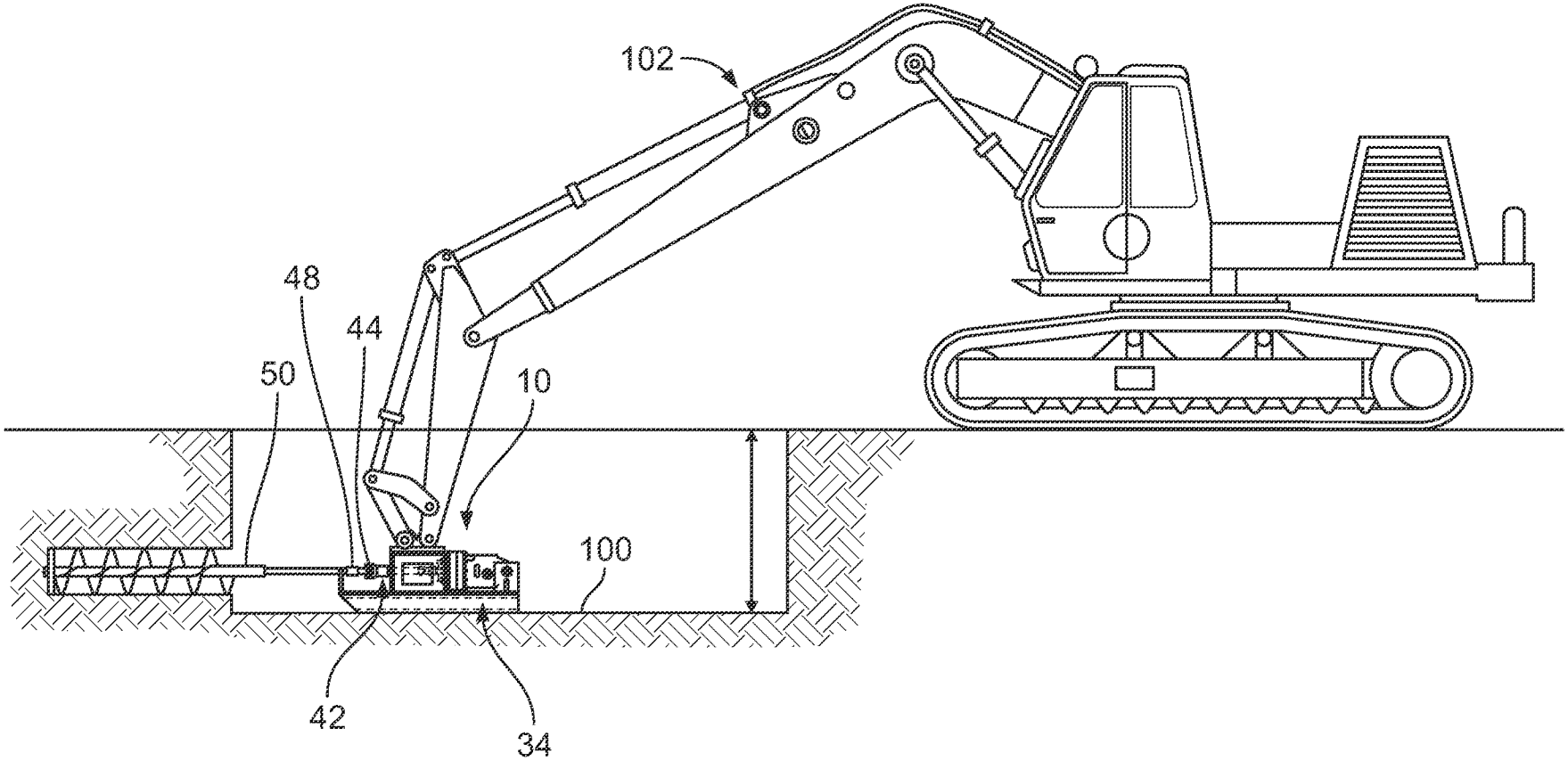
FIGS. 5 and 6 provide schematic depictions of a horizontal boring rig in use with construction equipment on a separate grade.
Figure 6:
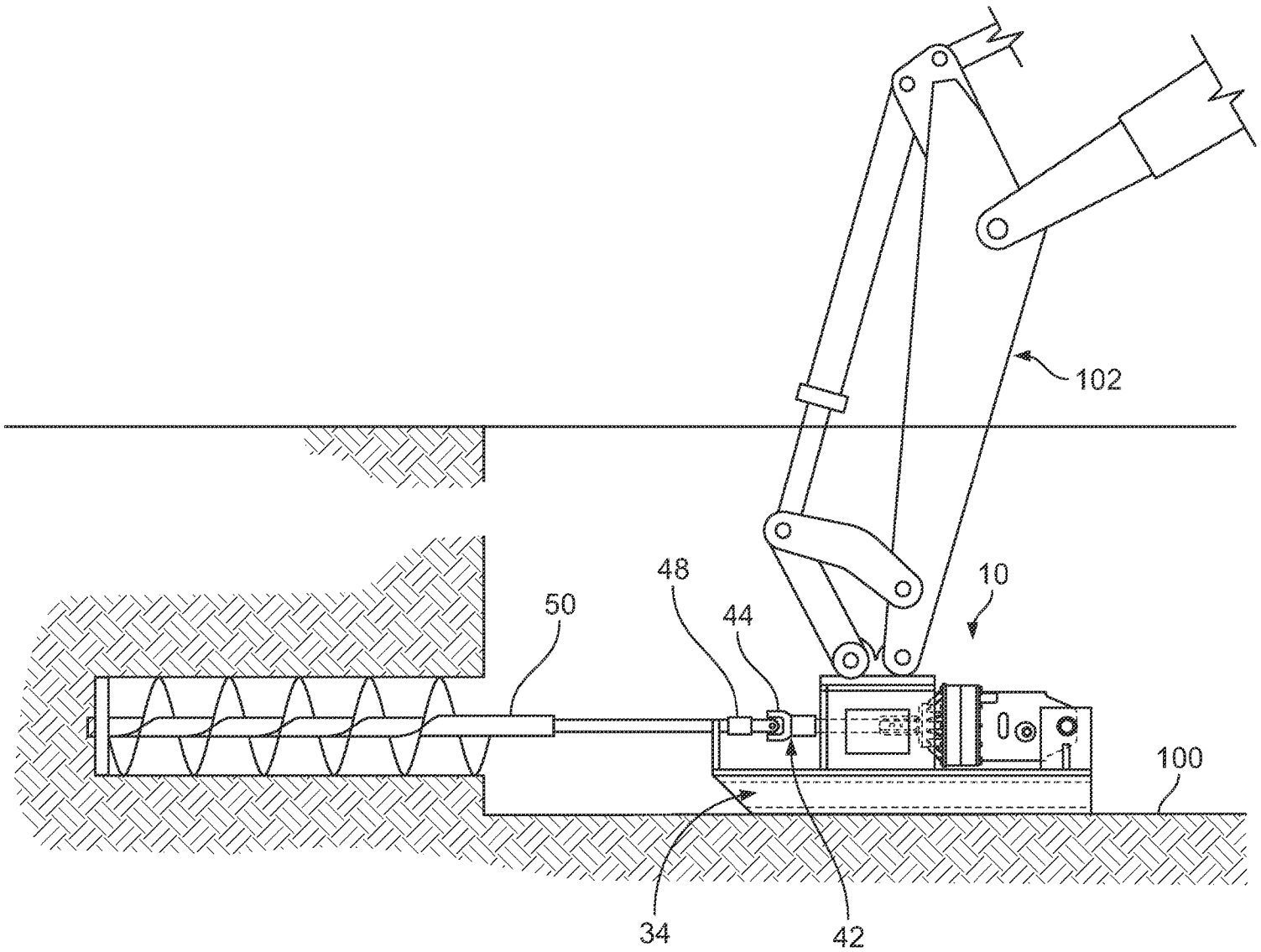

FIGS. 5 and 6 provide schematic depictions of a horizontal boring machine 10 coupled to an excavator 102 in use on a grade 100 separate from the excavator 102. The horizontal boring rig 10 may be in communication with an auger 50 via a coupling 48 on an intermediate shaft 42. The intermediate shaft 42 may comprise a universal joint 44 to allow for deflection and absorption of vibration, shock, kickback, or other forces that may cause breakage of the boring string or the horizontal boring rig 10. The horizontal boring rig 10 may receive pressurized hydraulic fluid from the excavator 102, and may be lifted, positioned, advanced, retracted, or otherwise moved as necessary by the excavator 102 during the excavation of a bore.

As shown, the horizontal boring rig 10 may be placed on a grade 100 separate from the excavator 102 that is coupled with the horizontal boring rig 10 and controlling the bore excavation. The horizontal boring rig 10 may ride along the grade 100 on one or more skids 34, which allow an operator to direct and control the excavation of the bore. The horizontal boring rig 10 may then operate in an enclosed space or on a grade 100 below (as shown) or above other equipment without the need for tracks or other guiding devices.

Figure 7:
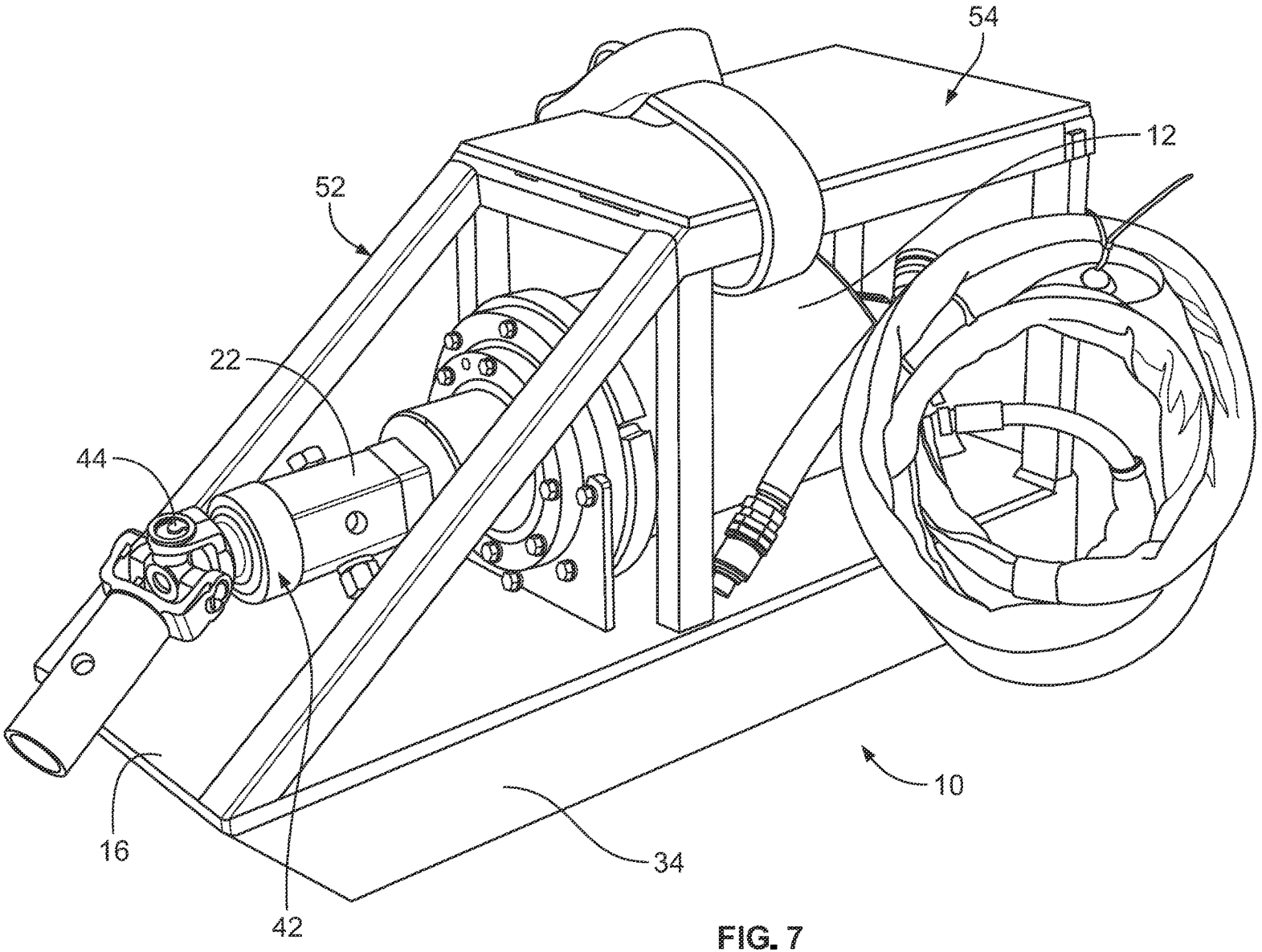
FIG. 7 provides a schematic depiction of a lighter duty horizontal boring rig.
Figure 8:
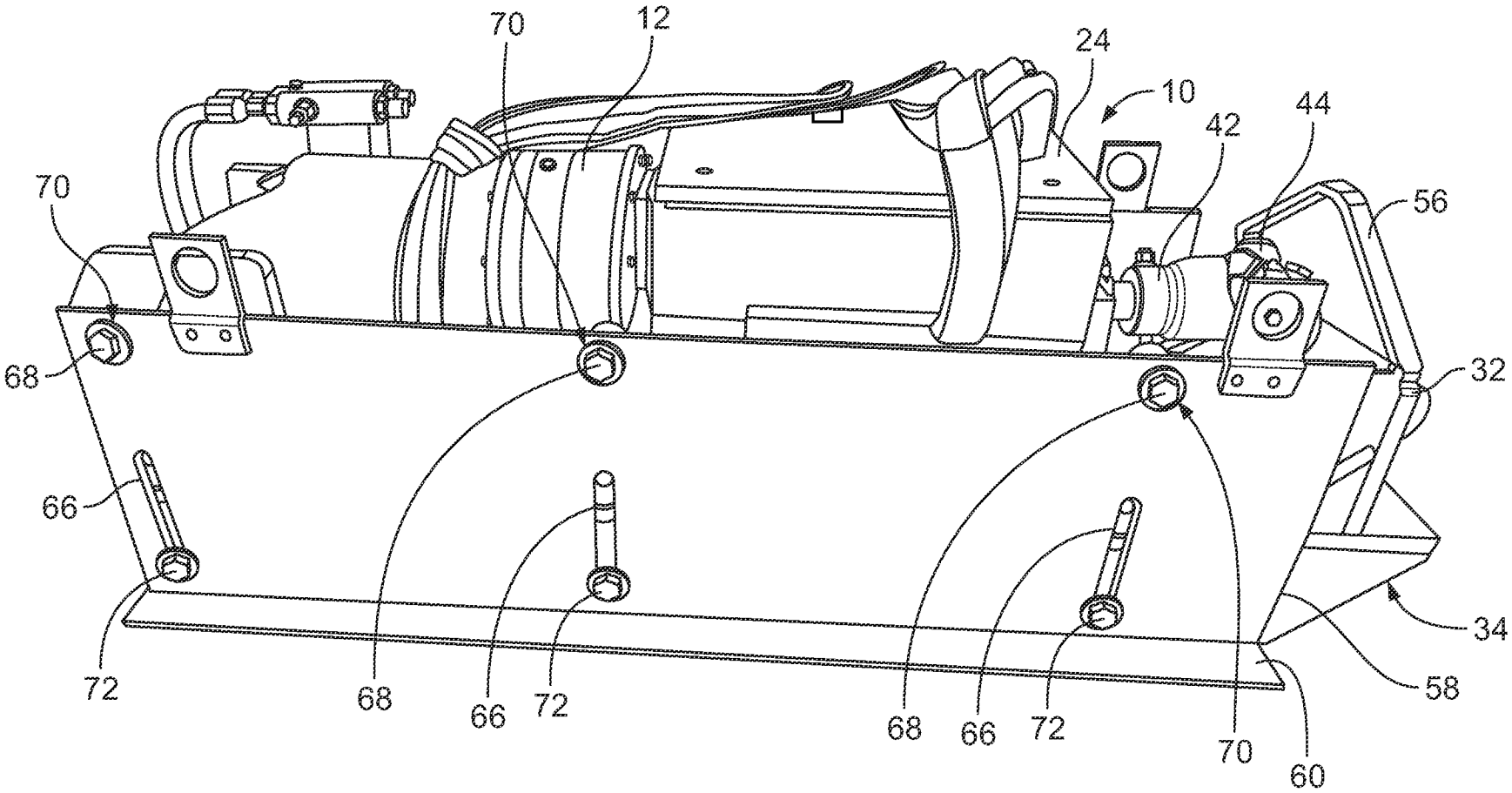
FIGS. 8-11 provide schematic depictions of a horizontal boring rig with adjustment plates for adjusting the height of the horizontal boring rig relative to the working grade.
Figure 9:
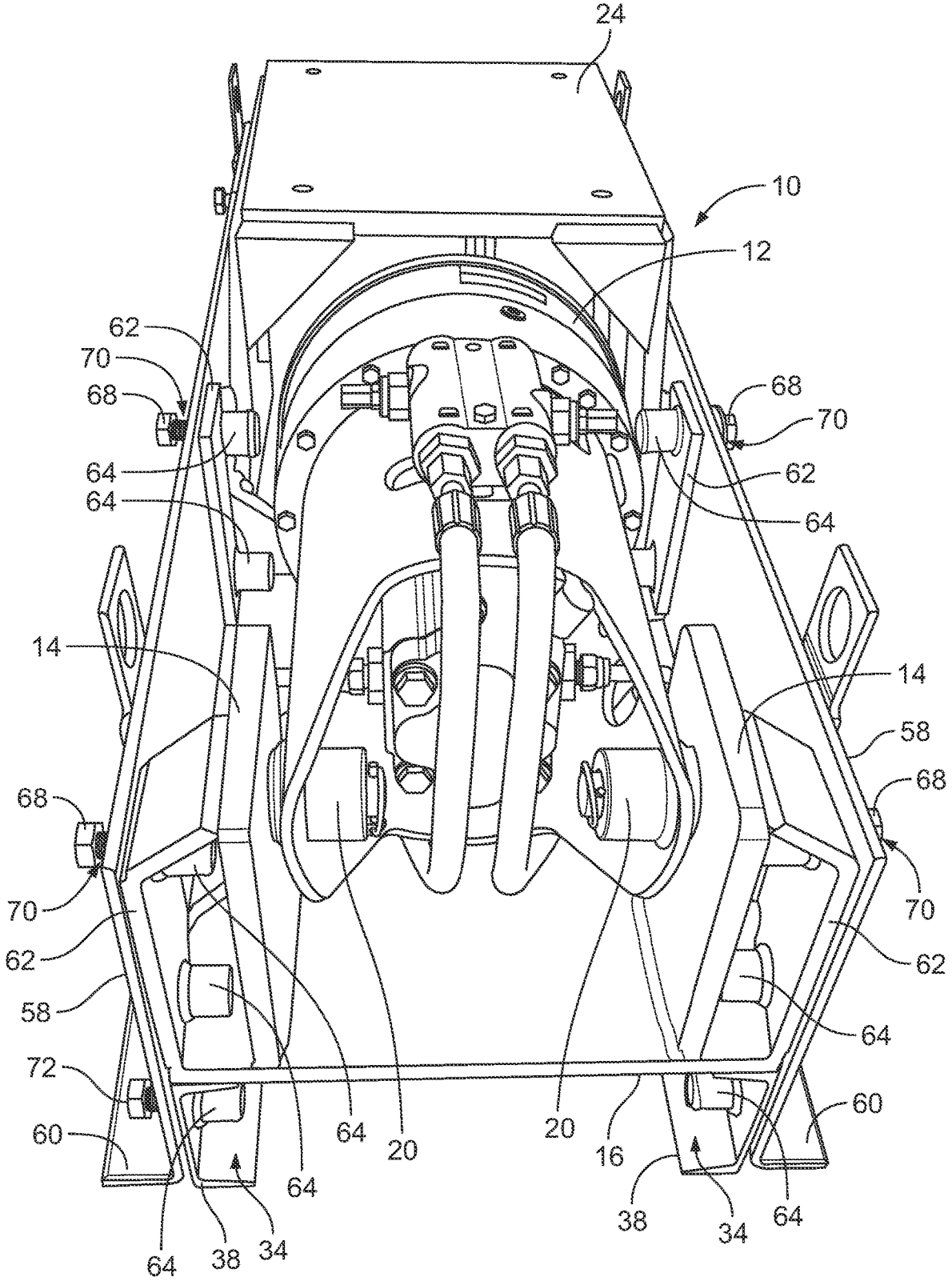
Figure 10:
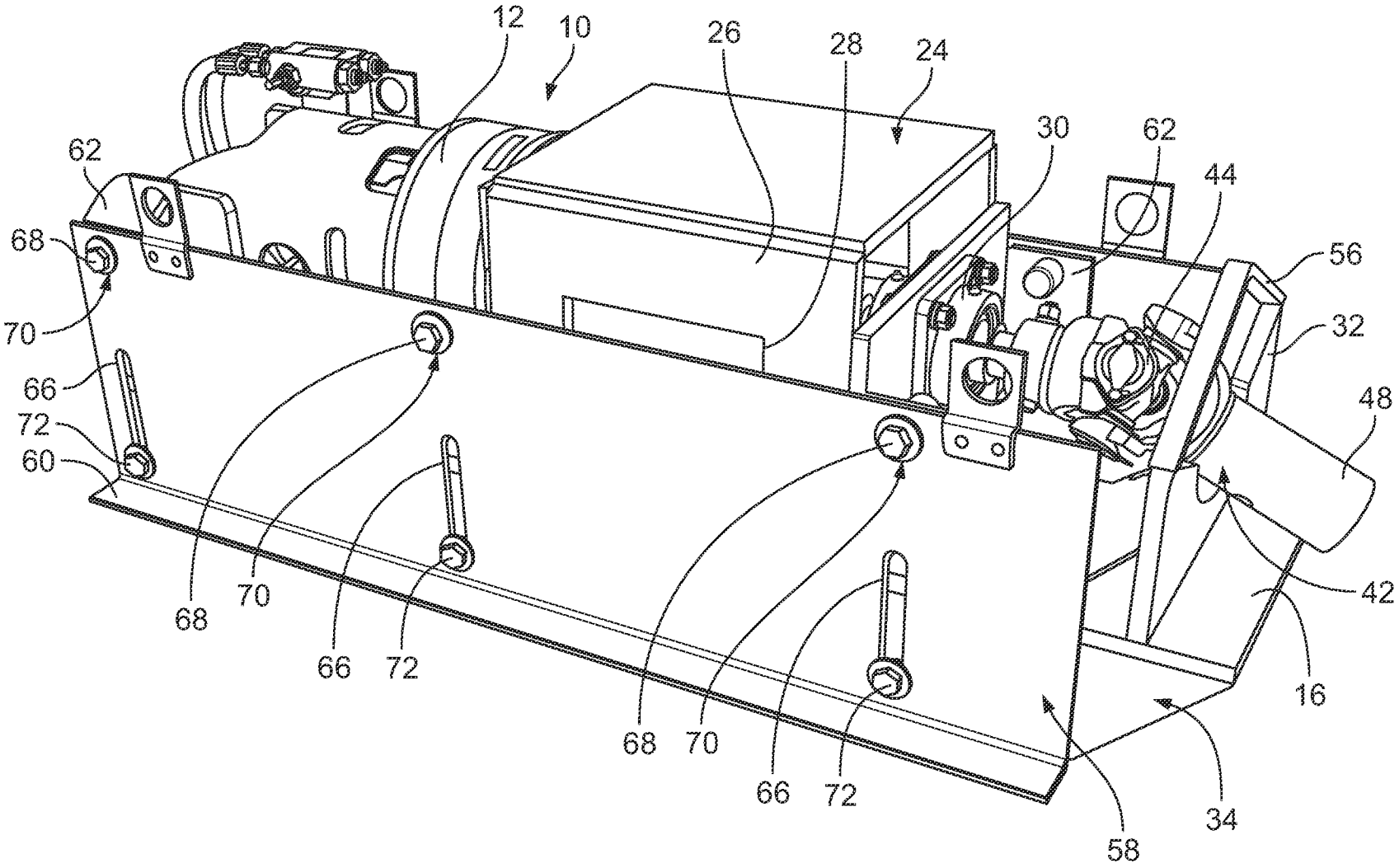
Figure 11:
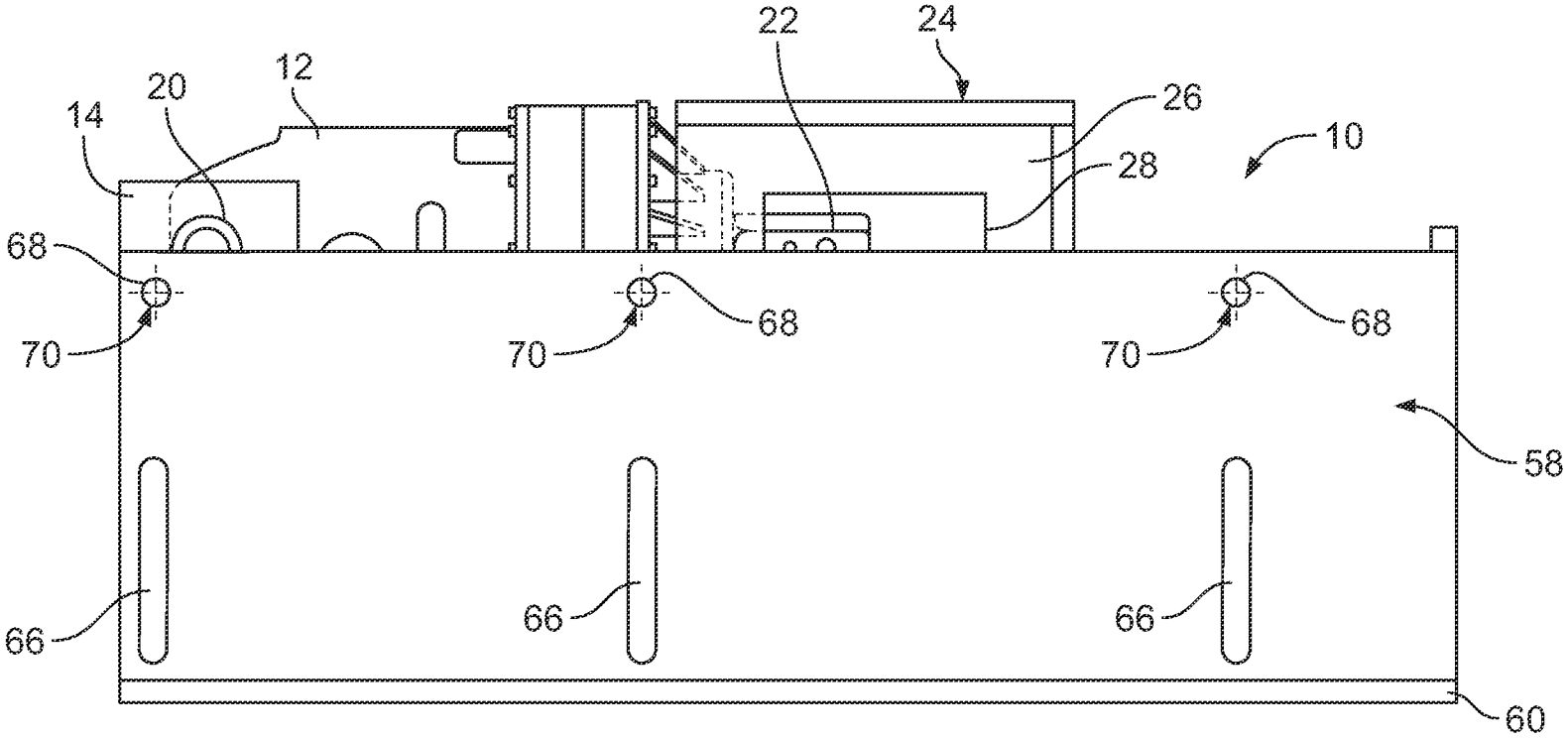

FIG. 7 provides a depiction of an embodiment of a horizontal boring rig 10 adapted for use in excavating shallower bores with lighter-duty excavation equipment. The horizontal boring rig 10 may comprise a base plate 16 riding on one or more skids 34 adapted to slide along a grade and guide the horizontal boring rig 10 during excavation of a bore. A hydraulic motor 12 may be enclosed within a support frame 52, which may comprise a top mount plate 54 for accepting equipment mounts to couple the horizontal boring rig 10 with excavation or construction equipment. The output shaft 22 of the hydraulic motor 12 may be coupled to an intermediate shaft 42, which may include or otherwise comprise a universal joint 44.

For use with bores of smaller diameter or shallower bores, the horizontal boring rig 10 may omit the presence of the front guide, an inspection box, and other features which support the use of excavation tools for larger diameter and deeper bores and the higher torque associated therewith. This smaller, lighter horizontal boring rig 10 may then be used in more confined spaces and with smaller, less powerful equipment. However, operation of the horizontal boring rig 10 is substantially similar, including attachment to a variety of equipment that may provide hydraulic, electric, or other types of power, and the use of skids 34 to guide the excavation of a bore relative to a grade. It should be appreciated that the universal joint 44 of the intermediate shaft 42 allows for deflection and absorption of kickback, vibration, and other forces encountered by the auger or other excavation tool to prevent breakage of the bore string, hydraulic motor 12, or other parts of the horizontal boring rig 10. In certain embodiments, the support frame 52 may be configured, shaped, or otherwise adapted to provide a function similar to a front guide. The support frame 52, particularly the angled front bars, may provide some limitation to the deflection of the universal joint 44 during use of the horizontal boring rig 10.

FIGS. 8-11 provide depictions of a horizontal boring rig 10 with height adjustment relative to the grade used to align, guide, and direct the excavation of a bore. The horizontal boring rig 10 may comprise a hydraulic motor 12 in rotatable communication with one or more pivot plates 14 through one or more pivots 20. The one or more pivot plates 14 may be affixed or otherwise attached to the top side of a base plate 16, which may also support a front guide 32 with an upper frame 56 that fully encircles the intermediate shaft 42 at the opposite end of the horizontal boring rig 10. The output shaft 22 of the hydraulic motor 12 may be coupled with an intermediate shaft 42 and enclosed within a drive box 24 which may comprise an inspection plate 26 and an inspection aperture 28 for observing or conducting maintenance or repair on the coupling of the hydraulic motor 12 output shaft 22 and intermediate shaft 42. The intermediate shaft 42 may exit the drive box 24 through a front bearing 30, leaving the universal joint 44 of the intermediate shaft 42 exposed. It should be appreciated that in certain embodiments, the output shaft 22 of the hydraulic motor 12 may extend through the front bearing 30 and couple with the intermediate shaft 42 externally to the drive box 24. In alternative embodiments, the coupling of the intermediate shaft 42 to the output shaft 22 of the hydraulic motor 12 may be within the drive box 24 such that the intermediate shaft 42 is supported by the front bearing 30. The intermediate shaft 42 may then pass through the front guide 32 and upper frame 56 and extend a coupling 48 which may be used to attach or otherwise affix an auger or other excavation tool to the intermediate shaft 42. It should be appreciated that the coupling 48 may be integrated with the intermediate shaft 42, or it may be provided as a separate and replaceable piece for attachment to different types of auger or excavation tools.

The horizontal boring rig 10 may include one or more skids 34 affixed or otherwise attached to the base plate 16. The one or more skids 34, which may be channel shaped to allow for directing spoil from the bore excavation under and beneath the base plate 16 of the boring rig 10, may include a skid foot 38 for riding along the grade used to direct and align the horizontal boring rig 10 to the desired bore location.

Still referring to FIGS. 8-11, the horizontal boring rig 10 may include one or more adjustment plates 58 to allow for raising or lowering the height of the base plate 16, and subsequently the horizontal boring rig 10 and any attached auger or excavation tool, relative to the working grade used to align and position the horizontal boring rig 10. Height adjustment allows the horizontal boring rig 10 to bore in multiple positions from a single grade and to provide extra clearance for the horizontal boring rig 10 to accept larger augers or excavation tools for excavating larger diameter bores.

One or more adjustment plates 58 may be moveably affixed or attached to the horizontal boring rig 10 to allow for the adjustment plate 58 to be moved vertically relative to the base plate 16 of the horizontal boring rig 10. The adjustment plate 58 may then further comprise an adjustment plate foot 60 adapted for riding along a grade to allow for alignment and positioning of the horizontal boring rig 10 and, subsequently, the auger or other excavation tool and the excavated bore. As shown, the adjustment plate foot 60 may be directed towards the outside of the horizontal boring rig 10. However, it should be appreciated that the adjustment plate foot 60 may also be directed towards the inside of the horizontal boring rig 10 in the same direction of the skid foot 38. The skid foot 38 may then nest within the adjustment plate foot 60. In certain embodiments, the one or more adjustment plates 58 may replace the one or more skids 34 such that the adjustment plate foot 60 provides the riding surface for the horizontal boring rig 10 in all vertical positions of the adjustment plate 58.

The one or more adjustment plates 58 may be affixed or otherwise attached to the horizontal boring rig 10 through one or more plate supports 62 by a plurality of bolts 68, 72. As shown, the plate supports 62, which may include several different bosses 64 for accepting the plurality of bolts 68, 72 in different positions, may be in communication with the base plate 16 of the horizontal boring rig 10. The one or more adjustment plates 58 may include a plurality of holes 70, adjustment slots 66, or both. The one or more adjustment plates 58 may then be held in place against the plate supports 62 with a plurality of bolts 68, 72. As shown, one or more lock bolts 68 may be installed through holes 70 or apertures in the upper portion of the one or more adjustment plates 58 and into bosses 64 on the plate supports 62. These lock bolts 68 may then secure the one or more adjustment plates 58 into a fixed position for shipping, transport, lifting, or attachment to other construction or excavation equipment. Similarly, one or more adjustment bolts 72 may be installed through adjustment slots 66 in the adjustment plates 58 and into bosses 64 on the plate supports 62 or skids 34. It should be appreciated that while the adjustment slots 66 are illustrated below holes 70, the adjustment slots 66 and holes 70 may be located in any relation to one another across the adjustment plates 58 as necessary to fit a particular configuration of the skids 34, base plate 16, plate supports 62, or other attachment locations on the horizontal boring rig 10.

To modify the height of the horizontal boring rig 10 relative to the working grade, a user may remove the lock bolts 68 that hold the one or more adjustment plates 58 in a fixed position, loosen the adjustment bolts 72, and then move the one or more adjustment plates 58 vertically relative to the horizontal boring rig 10. When the one or more adjustment plates 58 are positioned as desired to achieve the correct height of the intermediate shaft 42 and auger or other excavation tool, the adjustment bolts 72 may be tightened down in the adjustment slots 66 again to secure the one or more adjustment plates 58 in position. The lock bolts 68 may then be set aside, returned to their bosses 64 for storage during use, or installed into other bosses 64 that may align with the adjustment slots 66 on the one or more adjustment plates 58 to more securely hold the one or more adjustment plates 58 into position.

Still referring to FIGS. 8-11, a number of modifications or variations to the height adjustment of the horizontal boring rig 10 may also be possible. For example, the adjustment slots 66 on the one or more adjustment plates 58 may be formed in the plate supports 62 or other parts of the horizontal boring rig 10. The one or more adjustment plates 58 may also be affixed or otherwise attached to the horizontal boring rig 10 or any of its parts through other fastening means, such as cam locks or other mechanical fastening means that allow the one or more adjustment plates 58 to be repositioned relative to the horizontal boring rig 10. In certain embodiments, the lock bolts 68, adjustment bolts 72, or other fasteners may be secured with a nut instead of threading into a boss 64 on the horizontal boring rig 10. Furthermore, the one or more adjustment plates 58 may take on any shape, size, or configuration as desired or required for a particular application. For example, the one or more adjustment plates 58 may be provided in separate pieces to allow for easier transport, storage, or adjustment of the height of the horizontal boring rig 10. In still further embodiments, the horizontal boring rig 10 may feature one or more jack screws or other threaded adjustments between the base plate 16 of the boring rig 10 and the skids 34. A user may then turn the jack screws or other threaded adjustments to raise the base plate 16 of the horizontal boring rig 10 relative to the skids 34 and adjust the overall height of the auger or other excavation tool. The jack screws or other threaded adjustments may then either be self-supporting, or they may include locking nuts to secure the base plate 16 of the horizontal boring rig 10 in its position relative to the skids 34.

Referring to FIGS. 1-11, the horizontal boring rig 10 may include a number of other features or modifications as necessary to suit a particular application or use case. For example, the horizontal boring rig 10 may include a hydraulic motor 12, an electric motor, or any other mechanism that may be powered or activated by construction or excavation equipment coupled with the horizontal boring rig 10. In certain embodiments, the hydraulic motor 12 or electric motor of the horizontal boring rig 10 may include gear reductions, valve bodies, or other mechanisms to provide torque multiplication, speed control, or torque control. These mechanisms may be controlled directly on the horizontal boring rig 10, or through connection to other construction or excavation equipment. In still further embodiments, the skids 34 of the horizontal boring rig 10 may take on additional features to enhance functionality. For example, the skids 34 of the horizontal boring rig 10 may have different geometry for the spoil channels 40 or may include geometry near the front of the skids 34 to more effectively direct spoil and to maintain adequate contact with the working grade. The front of the skids 34 may be angled such that the skid foot 38 or the base plate support 36 is further forward to maintain an angle of attack for the skid 34.

In summary, while the present invention has been described with respect to specific embodiments, many modifications, variations, alterations, substitutions, and equivalents will be apparent to those skilled in the art. The present invention is not to be limited in scope by any of the specific embodiments described herein. Indeed, various modifications of the present invention, in addition to those described herein, will be apparent to those of skill in the art from the foregoing description and accompanying drawings. Accordingly, the invention is to be considered as limited only by the spirit and scope of the following claims, including all modifications and equivalents.

It should be appreciated that any element, part, section, subsection, or component described with reference to any specific embodiment above may be incorporated with, integrated into, or otherwise adapted for use with any other embodiment described herein unless specifically noted otherwise or if it should render the embodiment device nonfunctional. Likewise, any step described with reference to a particular method or process may be integrated, incorporated, or otherwise combined with other methods or processes described herein unless specifically stated otherwise or if it should render the embodiment method nonfunctional. Furthermore, multiple embodiment devices or embodiment methods may be combined, incorporated, or otherwise integrated into one another to construct or develop further embodiments of the invention described herein.

Still other embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of this application. For example, regardless of the content of any portion (e.g., title, field, background, summary, abstract, drawing figure, etc.) of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated. Further, any activity or element can be excluded, the sequence of activities can vary, and/or the interrelationship of elements can vary. Unless clearly specified to the contrary, there is no requirement for any particular described or illustrated activity or element, any particular sequence or such activities, any particular size, speed, material, dimension or frequency, or any particular interrelationship of such elements. Accordingly, the descriptions and drawings are to be regarded as illustrative in nature, and not as restrictive. Moreover, when any number or range is described herein, unless clearly stated otherwise, that number or range is approximate. When any range is described herein, unless clearly stated otherwise, that range includes all values therein and all sub ranges therein. Any information in any material (e.g., a United States/foreign patent, United States/foreign patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such incorporated by reference material is specifically not incorporated by reference herein.

I claim:

1. A boring rig comprising: a base plate comprising a first end and a second end, a top side and a bottom side; a first skid comprising an upper end and a lower end; a second skid comprising an upper end and a lower end; wherein said upper end of said first skid is in communication with said bottom side of said base plate, and said upper end of said second skid is in communication with said bottom side of said base plate; a first skid foot in communication with said lower end of said first skid and a second skid foot in communication with said lower end of said second skid; at least one pivot plate in communication with said top side of said base plate proximate to said second end of said base plate, said at least one pivot plate comprising at least one pivot; a motor in communication with said top side of said base plate through said at least one pivot of said at least one pivot plate, wherein the motor has a longitudinal axis which is substantially parallel to a longitudinal axis of the first skid and/or the second skid, wherein the pivot allows the motor to rotate relative to the first skid and/or the second skid; said motor in communication with an intermediate shaft, said intermediate shaft comprising a universal joint; and a front guide in communication with said top side of said base plate proximate to said first end of said base plate; wherein said first skid foot and said second skid foot are configured to slide along a grade to support said boring rig, said rotational power source is configured to rotate said intermediate shaft, and said front guide is configured to limit the deflection of said universal joint of said intermediate shaft.

2. The boring rig of claim 1, wherein said motor comprises a hydraulic motor.

3. The boring rig of claim 1, further comprising an output shaft in communication with said motor and said intermediate shaft, wherein said output shaft transfers rotational power from said motor to said intermediate shaft.

4. The boring rig of claim 1, further comprising a rear motor support in communication with said top side of said base plate proximate to said second end of said base plate;

wherein said rear motor support may engage said motor when said rotational power source deflects or rotates about said at least one pivot of said at least one pivot plate.

5. The boring rig of claim 1, wherein said first skid, said first skid foot, and said bottom side of said base plate define a first spoil channel; and wherein said second skid, said second skid foot, and said bottom side of said base plate define a second spoil channel.

6. The boring rig of claim 5, wherein said first spoil channel is disposed toward said second spoil channel.

7. The boring rig of claim 5, wherein said first spoil channel is disposed away from said second spoil channel.

8. The boring rig of claim 1, further comprising a drive box;

wherein said drive box encloses a connection between said motor and said intermediate shaft.

9. The boring rig of claim 8, wherein said drive box further comprises an inspection plate with an inspection aperture;

wherein said inspection aperture is disposed such that the connection between said motor and said intermediate shaft may be observed or inspected.

10. The boring rig of claim 8, further comprising a front bearing;

wherein said front bearing is disposed in said drive box and is in communication with said intermediate shaft.

11. The boring rig of claim 1, wherein said front guide comprises a V-shape to limit the deflection of said universal joint.

12. The boring rig of claim 1, further comprising an upper frame;

wherein said upper frame is in communication with said front guide and said upper frame and said front guide encircle said intermediate shaft.

13. The boring rig of claim 8, further comprising an equipment mount in communication with said drive box;

wherein said equipment mount is adapted for releasably attaching to excavation equipment.

14. The boring rig of claim 1, further comprising a coupling in communication with said intermediate shaft;

wherein said coupling is adapted for releasably affixing said intermediate shaft with an excavation tool and said coupling is distal to said motor.

15. The boring rig of claim 1, further comprising a height adjustment mechanism adapted for adjusting the vertical clearance of said base plate from the grade.

16. The boring rig of claim 15, wherein said height adjustment mechanism comprises:

one or more plate supports in communication with said base plate of said boring rig;

a first adjustment plate in communication with a first adjustment plate foot; and a second adjustment plate in communication with a second adjustment plate foot;

wherein said first adjustment plate and said second adjustment plate are moveably affixed to said one or more plate supports such that the relative vertical position of said first adjustment plate and said second adjustment plate may be changed, and said first adjustment plate foot and said second adjustment plate foot are configured to slide along the grade to support said boring rig.

17. The boring rig of claim 16, further comprising at least one first adjustment slot disposed within said first adjustment plate and at least one second adjustment slot disposed within said second adjustment plate;

wherein said first adjustment plate is in communication with said one or more plate supports via said at least one first adjustment slot and said second adjustment plate is in communication with said one or more plate supports via said at least one second adjustment slot.

18. A boring rig comprising: a base plate comprising a first end and a second end, a top side and a bottom side; a first skid comprising an upper end and a lower end; a second skid comprising an upper end and a lower end; wherein said upper end of said first skid is in communication with said bottom side of said base plate, and said upper end of said second skid is in communication with said bottom side of said base plate; a first skid foot in communication with said lower end of said first skid and a second skid foot in communication with said lower end of said second skid; a motor in communication with said top side of said base plate, wherein the motor has a longitudinal axis which is substantially parallel to a longitudinal axis of the first skid or the second skid, wherein a pivot on a pivot plate allows the motor to rotate relative to the first skid and/or the second skid; said motor in communication with an intermediate shaft, said intermediate shaft comprising a universal joint; a support frame in communication with said top side of said base plate, wherein said first skid foot and said second skid foot are configured to slide along a grade to support said boring rig; and said first skid, said first skid foot, and said bottom side of said base plate define a first spoil channel, said second skid, said second skid foot, and said bottom side of said base plate define a second spoil channel; and said rotational power source is configured to rotate or apply rotational power to said intermediate shaft, and said universal joint is configured to absorb deflection or shock during use of said boring rig.

19. The boring rig of claim 18, wherein said motor comprises a hydraulic motor.

20. A boring rig comprising:

a base plate comprising a first end and a second end, a top side and a bottom side;

a rear motor support in communication with said top side of said base plate proximate to said second end of said base plate;

a first skid comprising an upper end and a lower end;

a second skid comprising an upper end and a lower end;

wherein said upper end of said first skid is in communication with said bottom side of said base plate, and said upper end of said second skid is in communication with said bottom side of said base plate;

a first skid foot in communication with said lower end of said first skid and a second skid foot in communication with said lower end of said second skid;

wherein said first skid, said first skid foot, and said bottom side of said base plate define a first spoil channel and said second skid, said second skid foot, and said bottom side of said base plate define a second spoil channel;

at least one pivot plate in communication with said top side of said base plate proximate to said second end of said base plate, said at least one pivot plate comprising at least one pivot;

a hydraulic motor comprising an output shaft in communication with said top side of said base plate through said at least one pivot of said at least one pivot plate;

said hydraulic motor in communication with an intermediate shaft via said output shaft, said intermediate shaft comprising a universal joint;

a drive box comprising an inspection plate with an inspection aperture and a front bearing, said drive box enclosing a connection between said output shaft and said intermediate shaft, and said inspection aperture disposed such that the connection between said output shaft and said intermediate shaft may be inspected and said front bearing is in communication with said intermediate shaft;

one or more plate supports in communication with said base plate;

a first adjustment plate comprising at least one first adjustment slot disposed within said first adjustment plate and in communication with a first adjustment plate foot;

a second adjustment plate comprising at least one second adjustment slot disposed within said second adjustment plate and in communication with a second adjustment plate foot;

said first adjustment plate being in moveable communication with said one or more plate supports via said at least one first adjustment slot and said second adjustment plate being in moveable communication with said one or more plate supports via said at least one second adjustment slot;

a front guide comprising a V-shape in communication with said top side of said base plate proximate to said first end of said base plate; and an upper frame in communication with said front guide;

wherein said first skid foot and said second skid foot are configured to slide along a grade to support said boring rig, said hydraulic motor may rotate said intermediate shaft, said front guide and said upper frame may limit the deflection of said universal joint of said intermediate shaft and said rear motor support may engage said hydraulic motor when said hydraulic motor deflects or rotates about said at least one pivot of said at least one pivot plate.

* * * * *